United States Patent [19]

Hauptmann et al.

[11] Patent Number: 4,534,070

[45] Date of Patent: Aug. 13, 1985

[54] AUTOMATIC TOILET BOWL CLEANER AND DEPLETION SIGNAL

[75] Inventors: Michael C. Hauptmann, Pearl River, N.Y.; Charles G. Russomanno, Irvington, N.J.

[73] Assignee: Block Drug Company, Inc., Jersey City, N.J.

[21] Appl. No.: 637,747

[22] Filed: Aug. 6, 1984

[51] Int. Cl.[3] ..... E03D 9/02

[52] U.S. Cl. ..... 4/228; 4/222; 4/227; 73/307; 116/227; 116/228; 137/558; 222/23; 239/35; 215/366

[58] Field of Search ..... 4/222, 227, 228, 415, 4/661; 222/23, 500, 51; 137/40, 44, 559, 558; 73/305, 306, 307, 322.5; 116/227, 228; 239/35

[56] References Cited

U.S. PATENT DOCUMENTS

| | | | |
|---|---|---|---|
| 874,393 | 12/1907 | Collins | 215/366 |
| 2,293,475 | 8/1942 | Serra | 215/366 |
| 2,671,424 | 3/1954 | Herring et al. | 116/227 X |
| 2,888,685 | 6/1959 | Giangrosso | 222/500 X |
| 3,877,081 | 4/1975 | Klein | 4/228 X |
| 4,350,666 | 9/1982 | Klutts | 4/228 X |
| 4,450,594 | 5/1984 | Hotchkin | 4/227 X |

*Primary Examiner*—Henry K. Artis

*Attorney, Agent, or Firm*—Ostrolenk, Faber, Gerb & Soffen

[57] ABSTRACT

A water treatment container for utilization in a tank of a toilet bowl having an upper chamber through which water may circulate; an intermediate wall separating the upper chamber from a lower chamber, the intermediate wall carrying water treatment material which may be used up and if necessary a ballast material, the lower chamber being sealed to be buoyant. The weight of the water treatment material and, if necessary, the ballast, is such as to hold the container in the tank in an orientation where the air chamber is the lower one standing on the bottom wall of the tank. An additional chamber at the bottom of the container having an opening extending to the bottom wall is provided, said additional chamber carrying a water coloring material. When the water treatment material and, if used, the ballast, reach a point where the buoyancy of the lower chamber will overcome the weight of the material in the upper chamber, the container will be inverted, so that the opening to the additional chamber carrying the water coloring material will now be available to the water in the tank and color the water to provide a signal that the water treatment material is about to be used up.

7 Claims, 8 Drawing Figures

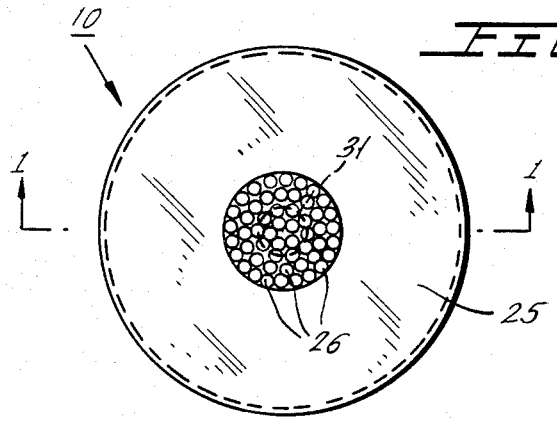
FIG. 3
FIG. 1
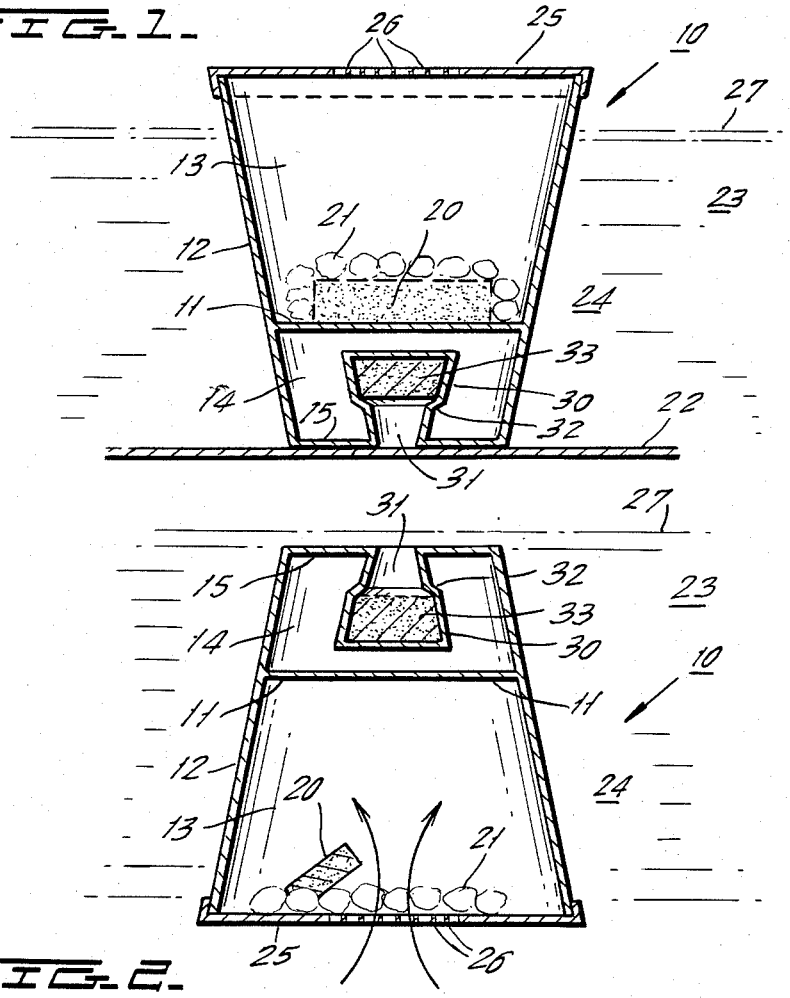
FIG. 2

AUTOMATIC TOILET BOWL CLEANER AND DEPLETION SIGNAL

The present invention relates to disinfectant or deodorant devices for utilization in tanks, particularly toilet bowl tanks, and more specifically to a disinfectant or deodorant device container which will signal the end or approaching end of the disinfectant or deodorant means utilized in the device in order that a replacement may be made. More specifically, the present invention relates to a container for disinfectant or deodorant so arranged that when the active material is used up or has reached a predetermined level of use, the container will change its position to release a signal in the form of a dye or other material which will provide a visible indication of the approaching end of the active material. In particular, the present invention is directed to a container to be placed in the tank, wherein the container will be flipped or inverted when the active material has reached an appropriate level of use to release the dye which will provide an indication of the fact that the deodorant or disinfectant or the combined material is approaching the end of its useful life.

BACKGROUND OF THE INVENTION

Many devices have been utilized in order to provide disinfectant or deodorant material for tanks, particularly toilet tank bowls, so that active material may be released into the toilet bowl during each flush and provide appropriate sanitary and environmental conditions in the area of the toilet bowl. The problem has always existed for determining when the material is used up without waiting for specific undesirable indications of the fact that the active material is gone. One method of providing such indication is to color the disinfectant material so that it in turn colors the toilet bowl water, thereby providing a permanent color indication of the fact that the disinfectant material is present. This discoloration of the toilet bowl water, however, is not always acceptable to the user and in fact depending on the attitude of the individual user, provides an indication of the utilization of disinfectant which the user may not desire. If, however, a disinfectant or deodorant which does not color the water is utilized, there is no dependable indication of the fact that the disinfectant is used up, such as occurs when the disinfectant constantly colors the water. In this case, the arrangement of a disinfectant or deodorant supply so that a visible indication is provided of the using up of the active material becomes important.

Various devices have been used in the prior art to provide such an indication at the container itself. Since, however, the container for disinfectant material is normally inserted in the tank, such indication is not a positive, readily available indication which the user can observe readily. Other devices have been utilized to provide signals of various types, but such signals have almost invariably been located at the container itself.

SUMMARY OF THE INVENTION

The present invention is directed to the object of providing a disinfectant container wherein the disinfectant or deodorant material is supported in the container at a level above the bottom of the container. The volume of the container below the supported level for the disinfectant or deodorant is so arranged that it is filled only with air. In addition, the layer section of the container below the support level for the disinfectant or deodorant material is provided with a smaller section containing a dye. The communication of this smaller container with the water in the tank is blocked either by the fact that an opening into the smaller container engages the bottom of the tank during use or by an automatically operating valve such as a ball valve sufficiently heavy to sit in an opening from the smaller container to the bottom and prevent passage of material from the smaller container through the bottom outside of the container.

The level of support for the deodorant and material above the bottom of the container is such that as the deodorant or disinfectant material is used up, this material will no longer cause the container as a whole to maintain its orientation with the bottom surface against the bottom of the tank and the air chamber.

When the active material is used up, the air space in the lower section of the container now causes an inversion of the container, opening the smaller containers or the dye or coloring matter at what was the bottom of the disinfectant or deodorant container to be exposed at the top and water in the tank may now pass through the smaller container, picking up the dye and thereby providing an indication to the user by the presence of the colored water in the toilet bowl that the disinfectant or deodorant material has been used up or is about to be used up. Where a valve is used at the opening from the smaller container to what was originally the bottom of the inside container, the ball valve will then fall away from the opening in order to provide access of the tank water to the smaller container. Access of tank water to the disinfectant material may still be maintained either through what was originally the top of the container or through additional holes at the side of the container near the top in order to use up the last bit of the active material.

In the event that the specific gravity of the active material is such as to prevent weighting of the container sufficiently to hold it in its original condition at the bottom of the container with the lower air chamber oriented toward the bottom of the tank, then appropriate inert ballast may be added of sufficient density or specific gravity that, together with the active material, it would provide the necessary weight. However, a balance must be struck as to when the using up of the active material will create the condition wherein the weight of the active material plus ballast will, at an appropriate point, be overbalanced by the buoyancy of the lower container to cause the entire container to flip.

The top of the container and even the sides of the container, or both, above the level of support of the active material may be perforated to admit an interchange of tank water with the water in the upper section of the container in order to permit the deodorant and disinfectant material to mingle with the tank water and be discharged therewith. However, the dye in the lower container must be of such nature and such density that it will not fall out of or dissolve out of the lower container during the ordinary use of the deodorant disinfectant container until after the container has flipped to an inverted position wherein the section containing the dye is completely available to the tank water to provide the necessary indication.

BRIEF DESCRIPTION OF THE DRAWINGS

The foregoing and many other objects of the present invention will become apparent from the following description description and accompanying drawings, in which:

FIG. 1 is a vertical cross-section of a deodorant and disinfectant container taken along line 1—1 through FIG. 3 of the present invention;

FIG. 2 is a view of the container of FIG. 1 in an inverted position after sufficient depletion of the active material and is a cross-sectional view similar to that of FIG. 1;

FIG. 3 is a top view of the covering portion of the container of FIG. 1, showing a plurality of openings therein to permit appropriate interchange of the water in the tank with the disinfectant material in the upper container of the composite deodorant disinfectant container;

DETAILED DESCRIPTION OF THE INVENTION

Figure 4:
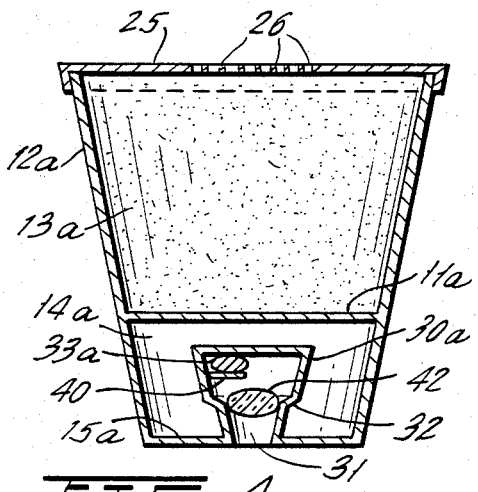
FIG. 4 is a cross-sectional view showing a modified form in which the lower container is provided with a valve which will operate automatically on inversion of the unit to permit release of dye into the tank water.
Figure 5:
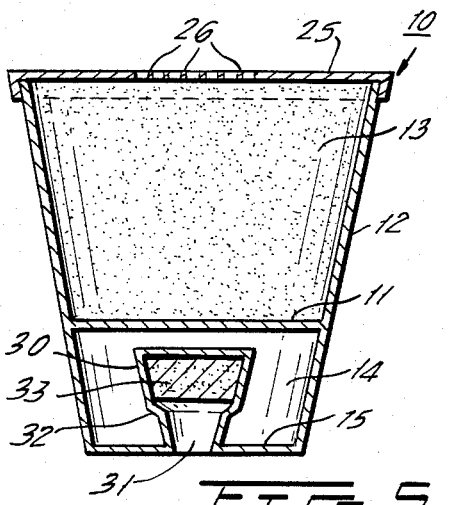
FIG. 5 is a cross-sectional view corresponding to the container of FIG. 1, wherein the dye material is retained in position by the shape of the dye containing container and the shape of the dye pellet which is used.

Referring first to FIGS. 1–3, the composite container 10 is provided with an internal shelf 11 which combines with the conical wall 12 of the container 10 to form in FIG. 1 an upper chamber 13 and a lower chamber 14. The lower chamber 14 is preferably sealed and coacts with the shelf 11 of the bottom wall 15 and the lower portion of the conical wall 12 to form an air chamber which for practical purposes may be regarded as sealed and thereby excluding water therefrom. The shelf 11 of the upper chamber is provided with a disinfectant deodorizing material 20 and if necessary, as above described, a ballast material 21 to provide sufficient weight in the upper chamber to overcome the buoyancy of the chamber 14 and maintain the container 10 in the orientation shown in FIG. 1 against the bottom wall 22 of the tank 23 containing the flushing water 24. The top of the container is provided with a cover 25 having a plurality of openings 26 therein so that the water 24 in the tank 23 may enter into the chamber 13, mix with the disinfectant 20, partially dissolving the disinfectant 20 and causing the disinfectant 20 to enter into the water 24 of the tank 23 in order to provide appropriate disinfectant and deodorant activity in the water 24 when it is flushed. The flushing operation may drop the level 27 of the water 24 in the tank 23 below the top of the tank 25 but on refill of the tank, the water level will rise above the top 25 and water interchange through the openings 26 at the top 25 will occur.

The lower chamber 14 is provided with an additional chamber 30 communicating through the opening 31 through the bottom 15 of the deodorant disinfectant container 10. When the container 10 is placed in the tank so that the wall 15 is against the bottom of the tank, the opening 31 is effectively closed and access of water in the tank 23 to the interior of the container 30 is limited. The container 30 is provided with an annular rim 32 which supports a pellet of dye or coloring material 33 compressed to a sufficient density that it will stay put in the container 30. The dye pellet 33 is preferably of the order of 1 gram by weight per cubic centimeter. As the disinfectant 20 is used up and finally reaches a point where the buoyancy in the chamber 14 will overcome the weight in the chamber 13, the container 10 will flip from the position of FIG. 1 to the position of FIG. 2.

It should be noted here that the weight of the disinfectant material 20 should also be of the order of 1 gram per cubic centimeter and the weight of the ballast may well be slightly more than 1 gram per cubic centimeter to make certain that as the disinfectant 20 is used up, the inversion from the condition of FIG. 1 to the condition of FIG. 2 will occur. The balancing of the weights may be obtained empirically. The essential element is that when the disinfectant deodorant material or block 20 approaches depletion, the balancing of the weight of the material on the partition or shelf 11 and of the air in the chamber 14 will be such as to cause the container to flip from the condition of FIG. 1 to the condition of FIG. 2. By this means, therefore, the opening 31 will be open to the water 24 in the tank 23 and there can then be an interchange of water in the chamber 30 with the tank water so that the dye can be dissolved into the tank water and thereby provide an indication that the container 10 has flipped from a position of FIG. 1 to the position of FIG. 2, or, more important to the user—that the disinfectant deodorant material is about to be used up.

As shown hereinafter in connection with the openings in the side of the container, which can be seen in FIGS. 7 and 8, what is left of disinfectant material can still be available for interchange with the water in the tank to provide disinfectant and deodorant to the tank water even while the dye is being released to indicate the depletion or impending depletion of the disinfectant material.

Figure 6:
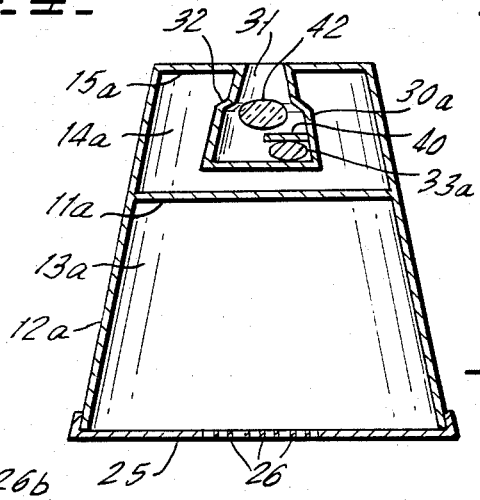
FIG. 6 is a cross-sectional view corresponding to that of FIG. 4, but inverted and showing the ball valve operated to a position where the interior dye pellet is available to the tank water.

Referring to FIGS. 4 and 6, the chamber **30*a* may be provided with a dye pellet 33*a* supported on its own shelf or other support 40 and the opening 31 to the chamber 30*a* may be closed by a ball valve 42 resting on the annular surface 32 in the chamber 30*a*. Inversion of the container from the position of FIG. 4 to the position of FIG. 6 will cause the ball valve 42 to drop away, as shown, and thereby open the chamber 30*a* to the tank water. For practical purposes, the fact that the top 25 of the container of FIG. 1 rests on the bottom of the tank to close the opening 31 is sufficient in most tanks and in any reasonable placement of the deodorant disinfectant container to close off the lower container 30 prior to the inversion of the unit. However, the utilization of the ball valve 42, as shown in FIGS. 4 and 6, will ensure that water will not penetrate into the container 30 for the dye until inversion has occurred. The ball valve may be a glass bead or any other material which has sufficient specific gravity to remain in place, as shown in FIG. 4** before the container has flipped over and fall away after the container has flipped over.

Figure 7:
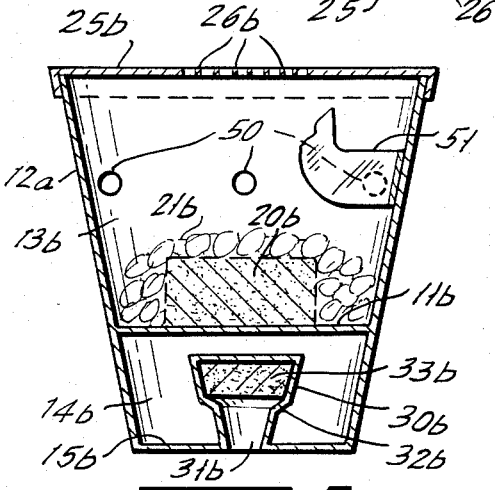
FIG. 7 is a cross-sectional view of the container of the present invention showing additional openings in the side of the container.
Figure 8:
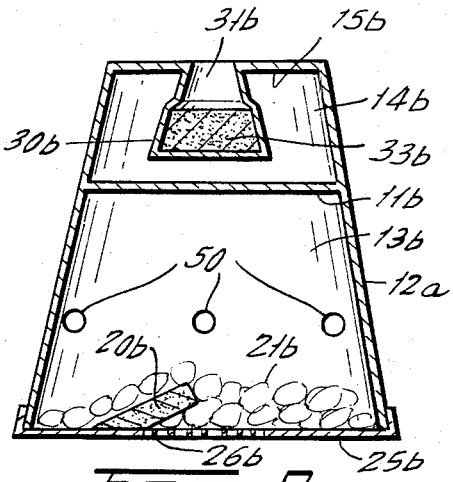
FIG. 8 is a view corresponding to that of FIG. 7, showing the container inverted as the relative buoyancies of the disinfect carrying section and the dye carrying section are changed.

In FIGS. 7 and 8 there is shown an additional element which may be used in connection with any of the structures herein described and as illustrated particularly in connection with the structures of FIGS. 1 and 2. The side wall 12*a* of the container may have a plurality of perforations 50, 50 which may initially be closed off by the removable tape 51. The top 25 may still have the openings 26 but the openings 50 may provide an efficient substitute therefor. In order to prevent the using up of the disinfectant material owing to conditions of humidity and other environmental conditions prior to the insertion of the container into the tank bowl, a tape 51 may be utilized temporarily to close the openings 50, the tape 51 being removable just prior to placement of the container in the tank. When the tape 51 is removed, the water in the tank may circulate through the holes 50 as well as the openings 26*b* if they are used in order to provide a sufficient amount of disinfectant or deodorant material to the tank water. When the container is inverted owing to the deterioration of the disinfectant block 20*b*, then the dye pellet 33*b* is available for coloring the tank water while nevertheless the disinfectant material may still be continuously dissolved in the tank water until it is fully used up.

In this way, the adjustment or selection of the appropriate weight of material on the support surface 11 in the container of FIG. 1 or 11*a* of FIG. 4 or 11*c* of FIG. 7 may be selected so that the buoyancy of the chamber 14 or 14*a* or 14*b* to overcome the weight of the material on the shelf 11 will be such that the dye will be released as an indicator not at the end of the deodorant or disinfectant pellet, but at a sufficient period before the end of the pellet 20 to provide time to make a change without having to do so instantaneously. This selection of the time differential will depend on the total weight of the material on the shelf 11, as compared with the buoyancy of the chamber 14 to determine how soon before the deodorant disinfectant pellet is used up the flip will occur.

It should be kept in mind that while some of the essential elements of prior devices which sought to provide a signal provided the signal at the container for the disinfectant and deodorant itself rather than a signal which was otherwise visible. Where other signals have been utilized, they have involved switches and mechanical devices. In the present instance, the signal is obvious to the user since a dye is released into the toilet bowl water when the disinfectant is used up or about to be used up and where the toilet bowl water itself may be colored for any reason, the dye which is released is simply of a contrasting color to indicate the approaching dissolution of the deodorant disinfectant pellet. Thus, the disinfectant device is fully self-contained, fully operative to provide an obvious signal without making it necessary to provide any other mechanical or electrical signals or making it necessary to open the toilet tank top to determine whether a signal is available.

In the foregoing, the present invention has been described solely in connection with preferred illustrative embodiments thereof. Since many variations and modifications of the present invention will now be obvious to those skilled in the art, it is preferred that the scope of the present invention be determined not by the specific disclosures contained herein but only by the appended claims.

What is claimed is:

1. A toilet bowl water treatment device comprising a container having a bottom wall, a top wall and an intermediate wall defining an upper chamber and a lower chamber; means for supporting material for treatment of the water on the intermediate wall; the lower chamber being closed to provide an inner chamber; the upper chamber in which said treatment material is carried being accessible to external water; an additional chamber at the bottom of the container; said additional chamber being open to the bottom of the container and containing a water coloring material supported therein; the opening from the additional chamber to the bottom wall of the chamber being substantially closed when the container is placed on a flat surface.

2. The toilet bowl water treatment device of claim 1, wherein the balance between the weight of the water treatment material on the intermediate wall and the buoyancy of the lower chamber is such that as the treatment material on the intermediate wall is used up, the buoyancy of the lower chamber will cause the container to be inverted, thereby opening the passage from the additional chamber containing the coloring material to the water.

3. The toilet bowl water treatment device of claim 2, wherein a gravity operated valve is provided for said opening, said gravity operated valve being automatically opened when the container is inverted.

4. The toilet bowl water treatment device of claim 2 wherein additional ballasting material is placed on the intermediate wall, together with the water treatment material in order to strike a predetermined balance between the weight of the material on the intermediate wall of the container and the buoyancy of the chamber below the intermediate wall to cause the container to invert at a predetermined balance between the weight of the material on said intermediate wall and the buoyancy of the chamber.

5. The toilet bowl water treatment device of claim 2, wherein a plurality of openings are provided in the top of the container to permit interchange of water between the portion of the container having the water treatment material and the remainder of the tank.

6. The toilet bowl water treatment device of claim 2, wherein additional openings are provided in the wall upper chamber of the container to permit interchange of water between the water in the tank and the water treatment material.

7. The toilet bowl water treatment device of claim 6, in which a temporary closure is provided for such additional openings, said closure being removable prior to use of the container.

* * * * *